US010940689B1

(12) United States Patent
Tse et al.

(10) Patent No.: US 10,940,689 B1
(45) Date of Patent: Mar. 9, 2021

(54) MULTI-NOZZLE PRINT HEAD ASSEMBLY WITH INK RETRACTION MECHANISM

(71) Applicant: THE REGENTS OF THE UNIVERSITY OF MICHIGAN, Ann Arbor, MI (US)

(72) Inventors: Lai Yu Leo Tse, Ann Arbor, MI (US); Kira Barton, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 0 days.

(21) Appl. No.: 16/561,382

(22) Filed: Sep. 5, 2019

(51) Int. Cl.
*B41J 2/14* (2006.01)

(52) U.S. Cl.
CPC ..... *B41J 2/14314* (2013.01)

(58) Field of Classification Search
CPC ..... B41J 2/14314
See application file for complete search history.

(56) References Cited

U.S. PATENT DOCUMENTS

| | | | | |
|---|---|---|---|---|
| 4,314,263 | A * | 2/1982 | Carley | G01D 15/18 347/44 |
| 9,415,590 | B2 | 8/2016 | Barton et al. | |
| 2004/0227785 | A1 | 11/2004 | Katsuta et al. | |
| 2006/0081643 | A1 | 4/2006 | Haluzak et al. | |
| 2007/0052771 | A1* | 3/2007 | Inoue | B01F 11/04 347/86 |
| 2011/0199433 | A1 | 8/2011 | Kim et al. | |
| 2012/0105528 | A1 | 5/2012 | Alleyne et al. | |
| 2014/0322451 | A1 | 10/2014 | Barton et al. | |
| 2015/0336388 | A1 | 11/2015 | Ohnishi | |

FOREIGN PATENT DOCUMENTS

| | | | |
|---|---|---|---|
| EP | 3050706 | A1 | 8/2016 |

OTHER PUBLICATIONS

Y. Han and J. Dong. "Design of Integrated Ring Extractor for High Resolution Electrohydrodynamic (EHD) 3D Printing." *Procedia Manufacturing* 5 pp. 1031-1042 (2016).

L. Y. L. Tse and K. Barton. "A Field Shaping Printhead for High-Resolution Electrohydrodynamic Jet Printing onto Non-Conductive and Uneven Surfaces." *Applied Physics Letters* 104, No. 14, pp. 143510 (2014).

J.S. Lee, Y.J. Kim, B.G. Kang, S.Y. Kim, J. Park, J. Hwng, and Y.J. Kim. "Electrohydrodynamic Jet Printing Capable of Removing Substrate Effects and Modulating Printing Characteristics." in *Micro Electro Mechanical Systems, 2009. MEMS 2009. IEEE 22nd International Conference on*, pp. 487-490. IEEE, 2009.

(Continued)

*Primary Examiner* — Jason S Uhlenhake
(74) *Attorney, Agent, or Firm* — Harness, Dickey & Pierce, P.L.C.

(57) ABSTRACT

A print nozzle assembly is presented for use in a printer. The print nozzle assembly may include: a printing pin; a wetting mechanism associated with the printing pin, and an ink retraction mechanism integrated into the wetting mechanism. The wetting mechanism includes an ink reservoir with an outlet arranged in close proximity to a tip of the printing pin. The ink retraction mechanism is configured to retract ink away from the outlet of the ink reservoir.

20 Claims, 9 Drawing Sheets

(56) References Cited

OTHER PUBLICATIONS

Y. Pan, Y.A. Huang, L. guo, Y. Ding, and Z. Yin. "Addressable Multi-Nozzle Electrohydrodynamic Jet Printing with High Consistency by Multi-Level Voltage Method." *AIP Advances* 5, No. 4, pp. 047108, 2015.

Xu, Lei, and Daoheng Sun. "Electrohydrodynamic Printing Under Applied Pole-Type Nozzle Configuration." *Applied Physics Letters* 102, No. 2 (2013): 024101.

International Search Report and Written Opinion of the International Searching Authority issued in PCT/US2019/021747, dated Jun. 25, 2019.

Park, J. U., Hardy, M., Kang, S. J., Barton, K., Adair, K., kishore Mukhopadhyay, D., . . . & Ferreira, P. M. (2007). High-resolution electrohydrodynamic jet printing. Nature materials, 6(10), 782.

* cited by examiner

MULTI-NOZZLE PRINT HEAD ASSEMBLY WITH INK RETRACTION MECHANISM

FIELD

The present disclosure relates to a multi-nozzle print head assembly with an ink retraction mechanism.

BACKGROUND

Convention electro-hydrodynamic multi-nozzle or multi-pin designs for print heads control ink release from individual nozzles or pins by applying voltage signal to one or more specific nozzles or pins. In this approach, the electrostatic field changes when different nozzles or pins are charged at different times to release ink materials. Variation in the electrostatic field causes undesirable changes to ink droplet trajectory, which leads to inconsistent printing results. This effect is often referred to as cross talk effect. Therefore, it is desirable to design a multi-nozzle print head assembly which results in the same electrostatic field across the different nozzles and thereby eliminates the cross talk effect.

This section provides background information related to the present disclosure which is not necessarily prior art.

SUMMARY

This section provides a general summary of the disclosure, and is not a comprehensive disclosure of its full scope or all of its features.

In one aspect, a print nozzle assembly is presented for use in a printer. The print nozzle assembly includes: a printing pin; a wetting mechanism associated with the printing pin; and an ink retraction mechanism integrated into the wetting mechanism. The wetting mechanism includes an ink reservoir with an outlet arranged in close proximity to a tip of the printing pin. The ink retraction mechanism is configured to retract ink away from the outlet of the ink reservoir.

A controller is electrically coupled to one of the printing pin and the ink reservoir. During a wetting process, the controller is configured to selectively control electro-hydrodynamic transfer of ink from the ink reservoir to the tip of the printing pin, for example by creating an electric potential between the printing pin and the ink reservoir.

In one embodiment, the ink retraction mechanism includes a flex member comprised of a piezoelectric material, such that the flex member is configured to deform and thereby create a vacuum in the ink reservoir in response to a drive signal from the controller.

In another aspect, a print head assembly is comprised of a plurality of print nozzles arranged adjacent to each other. Each print nozzle in the plurality of print nozzles includes a printing pin; a wetting mechanism associated with the printing pin; and an ink retraction mechanism integrated into the wetting mechanism. The wetting mechanism includes an ink reservoir with an outlet arranged in close proximity to a tip of the printing pin. The ink retraction mechanism is configured to retract ink away from the outlet of the ink reservoir.

A controller is also interfaced with each of the print nozzles in the plurality of print nozzles. During a wetting process, the controller is configured to selectively control electro-hydrodynamic transfer of ink from the ink reservoir to the tip of the printing pin in each of the print nozzles. More specifically, the controller is interfaced with each of the ink retraction mechanisms in the plurality of print nozzles and interacts with ink retraction mechanisms in a subset of print nozzles in the plurality of print nozzles to retract ink away from the outlet of the ink reservoir while concurrently transferring ink from the ink reservoir to the tip of the printing pin in other print nozzles in the plurality of print nozzles.

For a given print nozzle in the plurality of print nozzles, the controller transfers ink from the ink reservoir to the tip of the printing pin by creating an electric potential between the printing pin and the ink reservoir in the given print nozzle.

During the wetting process, the controller creates an electric potential with same value across the printing pin and the ink reservoir of each print nozzle in the plurality of print nozzles.

During a jetting process, the controller is configured to release the ink from the tip of the printing pin in each of the print nozzles. Specifically, the controller creates an electric potential with same value across the printing pin and the ink reservoir of each print nozzle in the plurality of print nozzles during the jetting process.

In one embodiment, the ink retraction mechanism includes a flex member comprised of a piezoelectric material, such that the flex member is configured to deform and thereby create a vacuum in the ink reservoir in response to a drive signal from the controller.

In a different aspect, a print head assembly is comprised of a plurality of print nozzles arranged adjacent to each other but each print nozzle does not include a wetting mechanism. Rather, each print nozzle is configured to hold ink and includes a tip from which ink is emitted. An ink retraction mechanism is integrated into each of the print nozzles in the plurality of print nozzles, such that a retraction mechanism is configured to retract ink away from the tip of print nozzle and back into the print nozzle. A jetting mechanism is arranged adjacent to the plurality of print nozzles and configured to release of ink from the plurality of print nozzles.

A controller is also interfaced with each of the print nozzles in the plurality of print nozzles. During a jetting process, the controller is configured to selectively release ink from each of the print nozzles in the plurality of print nozzles. More specifically, the controller is interfaced with each of the ink retraction mechanisms in the plurality of print nozzles and interacts with ink retraction mechanisms in a subset of print nozzles in the plurality of print nozzles to retract ink away from the tip of the print nozzles while concurrently releasing ink from other print nozzles in the plurality of print nozzles.

In one embodiment, the jetting mechanism is further defined as one or more electrodes, such that the controller is configured to release ink by creating an electric potential between the one or more electrodes and each of the print nozzles. The controller may create an electric potential between the one or more electrodes and each of the print nozzles by applying a voltage with same value to each print nozzle in the plurality of print nozzles.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
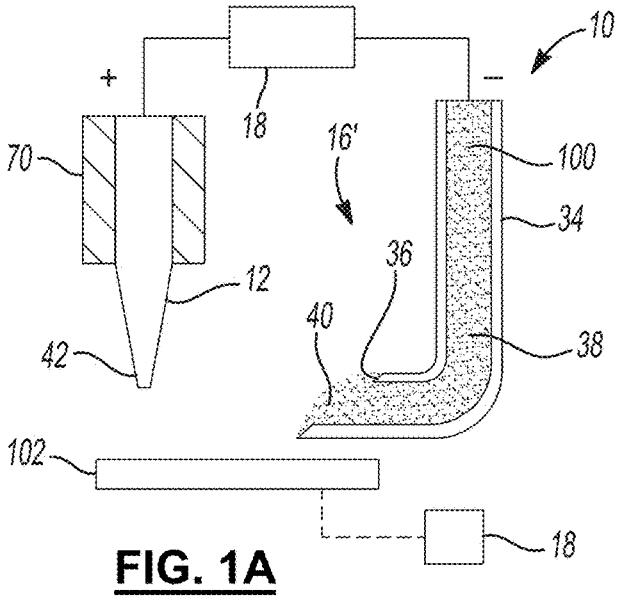
FIGS. 1A-1E depict an example print nozzle for use in a multi-nozzle print head assembly.
Figure 1B:
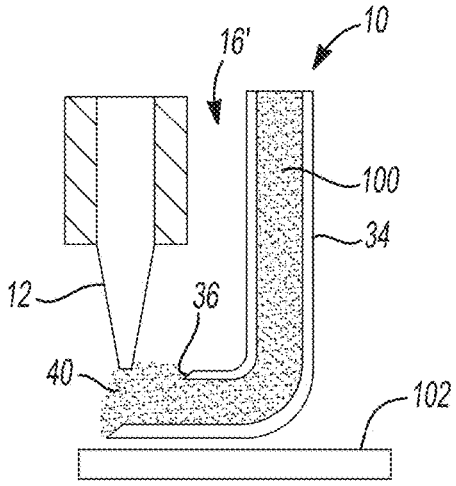
Figure 1C:
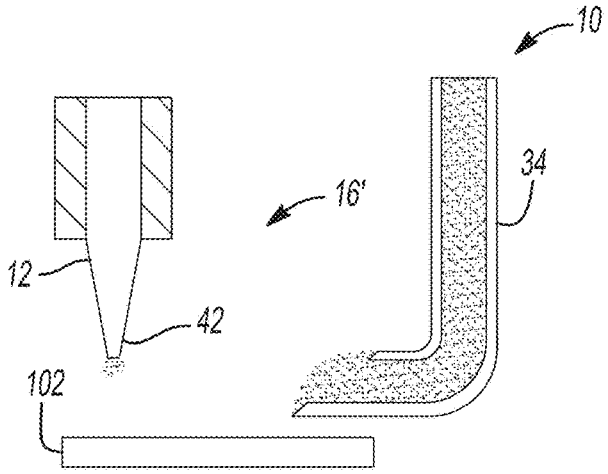
Figure 1D:
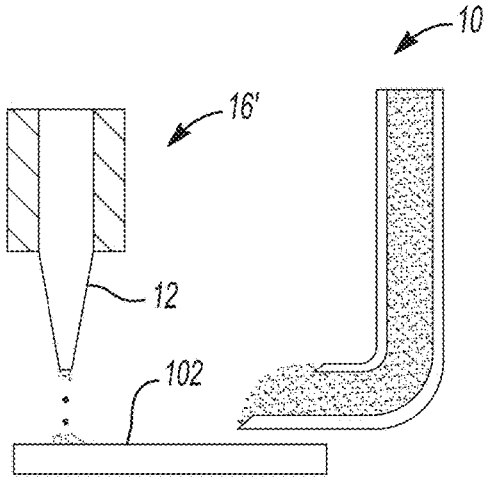
Figure 1E:
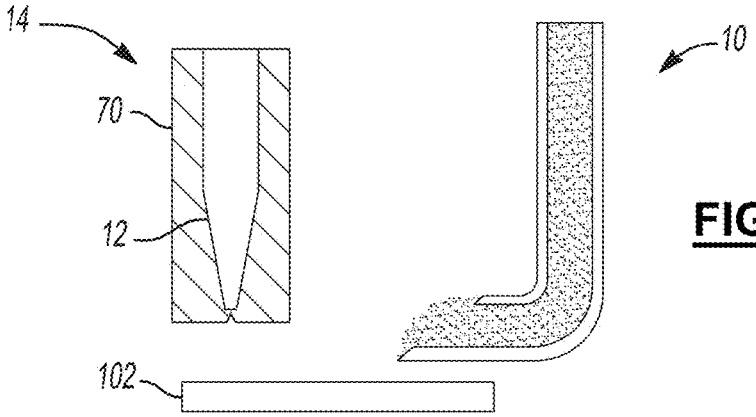
Figure 2:
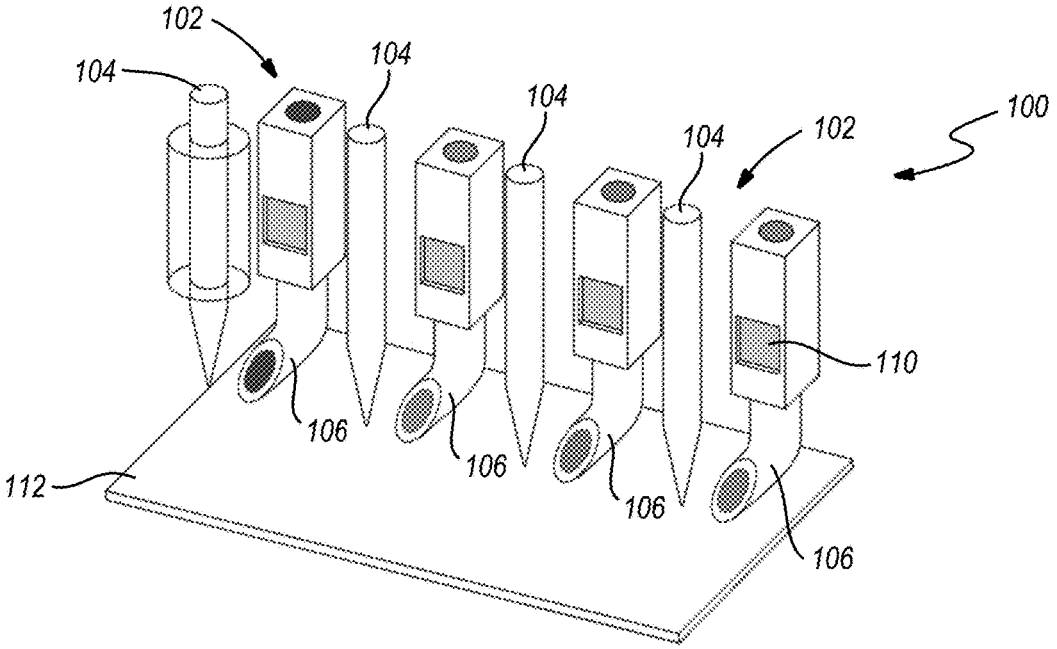
FIG. 2 depicts a first example embodiment of a multi-nozzle print head assembly.

Example embodiments will now be described more fully with reference to the accompanying drawings.

FIGS. 1A-1E depict an example print nozzle 10 for use in a multi-nozzle print head assembly. The print nozzle 10 includes a printing pin or needle member 12, a wetting mechanism 16 and a controller 18. The print nozzle 10 may also include an optical pin cleaning mechanism 14. It is to be understood that only the relevant parts of the print nozzle are discussed in relation to FIGS. 1A-1E, but that other components may be needed to implement the print nozzle.

In one example embodiment, the printing pin 12 is comprised of a conductive material. In other embodiments, the printing pin 12 is comprised of a readily-wettable outer surface (e.g., a metal surface for polar inks 100 or a surfaced treated for high wettability of non-polar inks 100). The tip diameter for the printing pin 12 is in the range of 1-20 μm although tips with other dimensions are envisioned by this disclosure.

The wetting mechanism 16 is configured to provide ink 100 to printing pin member 12 for application upon substrate 102. In the example embodiment, the wetting mechanism includes an ink reservoir 34 with an outlet 36 separate from but arranged in close proximity to the tip 42 of the printing pin 12. In some embodiments, ink reservoir 34 and printing pin member 12 are configured to be moved into proximity of each other such that the tip 42 of printing pin member 12 contacts meniscus 40 or is sufficiently close to transfer ink 100 to the tip 42 of the printing pin 12. To this end, ink reservoir 34 and/or printing pin 12 can be mechanically moveable relative to each other. The ink reservoir 34 can be generally L-shaped having an internal volume 38 and an upwardly-angled open end 36. The upwardly-angled open end 36 can promote formation of an ink meniscus 40. Other implementations for the wetting mechanism 16 are also contemplated by this disclosure.

The controller 18 is interfaced with the print nozzle 10. During the wetting process, the controller 18 is configured to selectively control electro-hydrodynamic transfer of ink from the ink reservoir 34 to the tip 42 of the printing pin 12. During the jetting process, the controller 18 is configured to release the ink from the tip 42 of the printing pin 12 and onto the substrate 102.

In the exemplary embodiment, the controller 18 is implemented as a microcontroller. It should be understood that the logic for the control of print nozzle by controller 18 can be implemented in hardware logic, software logic, or a combination of hardware and software logic. In this regard, controller 18 can be or can include any of a digital signal processor (DSP), microprocessor, microcontroller, or other programmable device which are programmed with software implementing the above described methods. It should be understood that alternatively the controller is or includes other logic devices, such as a Field Programmable Gate Array (FPGA), a complex programmable logic device (CPLD), or application specific integrated circuit (ASIC). When it is stated that controller 18 performs a function or is configured to perform a function, it should be understood that controller 18 is configured to do so with appropriate logic (such as in software, logic devices, or a combination thereof).

In this way, the print nozzle 10 is configured to accurately control the amount of ink 100 released onto the surface of substrate 102. Additionally, the print nozzle 10 is configured to control the duration of ink drying (which changes the ink rheology) before the ink droplet 100' is released into the air and lands on substrate 102 as deposited ink 100". In some embodiments, print nozzle 10 is able to print using previously unprintable ink materials 100, such as but not limited to alcohols, materials with high evaporation rates, high viscosity solvents with dissolved particles, larger particle suspensions, and the like that would previously result in clogging problems in conventional print heads.

FIGS. 2 and 4A-4F depict an example embodiment of a multi-nozzle print head assembly 100. The print head assembly 100 includes a plurality of print nozzles 102 arranged adjacent to each other. Each print nozzle 102 includes a printing pin 104 and a wetting mechanism 106 associated with the printing pin 104. For the most part, each print nozzle 102 is configured as described above in relation to FIGS. 1A-1E. Although four print nozzles are depicted, the print head assembly may include more or less print nozzles.

Furthermore, each print nozzle 102 in the print head assembly 100 is further configured with an ink retraction mechanism 110. The ink retraction mechanism 110 is integrated into the wetting mechanism 106 and configured to retract ink away from an outlet of the ink reservoir.

Figure 3A:
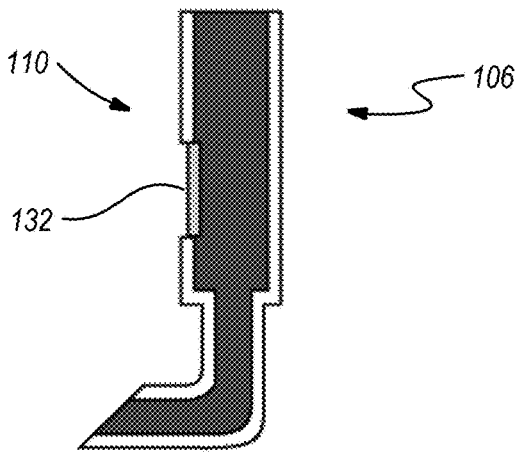
FIGS. 3A and 3B depict an example embodiment of an ink retraction mechanism in deactivated state and activated state, respectively.
Figure 3B:
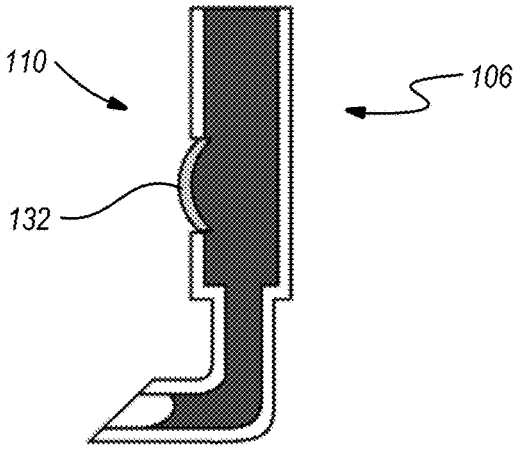

FIGS. 3A and 3B further illustrate an example embodiment of an ink retraction mechanism 110. In this example, the ink retraction mechanism is a flex member 132 formed into a wall of the ink reservoir as shown in FIG. 3A. The flex member 132 is preferably comprised of a piezoelectric material. While the flex member remains in a relaxed state, the ink is held at or near the outlet of the ink reservoir. Conversely, in response to a drive signal, the flex member 132 deforms as shown in FIG. 3B. The deformation of the flex member 132 creates a vacuum which in turn draws the ink away from the outlet of the ink reservoir.

In another example embodiment, the ink retraction mechanism may be a negative back pressure applied to the ink in the ink reservoir which also retract the ink away from the outlet of the reservoir. Different mechanisms for creating the back pressure are contemplated by this disclosure. Likewise, other types of implementations for the ink retraction mechanism are also contemplated by this disclosure.

Figure 4A:
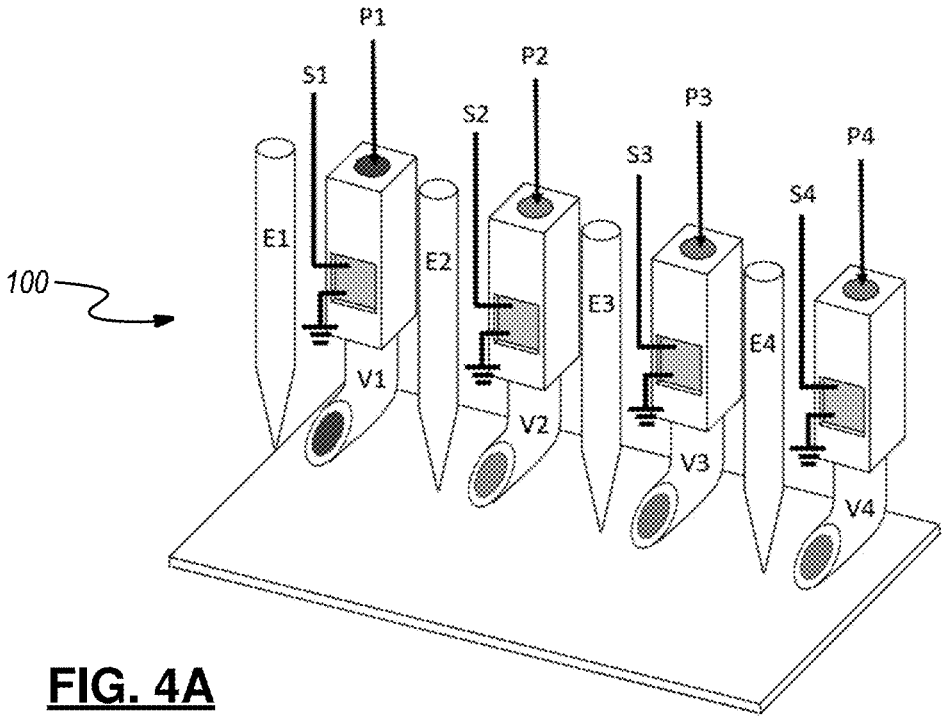
FIGS. 4A-4F illustrate operation of the first example embodiment of the multi-nozzle print head assembly.

With continued references to FIGS. 4A-4F, operation of the multi-nozzle print head assembly 100 is further described. In FIG. 4A, the printing process by the print head assembly 100 is in an idle state. In the idle state, there is no back pressure applied to the ink contained in the ink reservoirs. The back pressure is designated by P1, P2, P3 and P4. Additionally, there is no drive signal applied to the ink retraction mechanism 110 (i.e., 0 volts) and thus the ink retraction mechanism 110 is in a relaxed or deactivated state. The drive signal for the ink retraction mechanisms 110 are designated S1, S2, S3 and S4. Similarly, there is no electrical potential between the printing pin 104 and the ink reservoir 106 such that the ink meniscus is at or near the outlet of the ink reservoir. To create an electric potential between the printing pin 104 and the ink reservoir 106, a voltage can be applied to the printing pint and/or the ink reservoir. The voltage applied to the printing pins 104 is designated E1, E2, E3, E4; whereas, the voltage applied to the ink reservoirs 106 is designated V1, V2, V3, V4. In one embodiment, the voltage applied to the printing pin and to the ink reservoir is zero volts during the idle state.

Figure 4B:
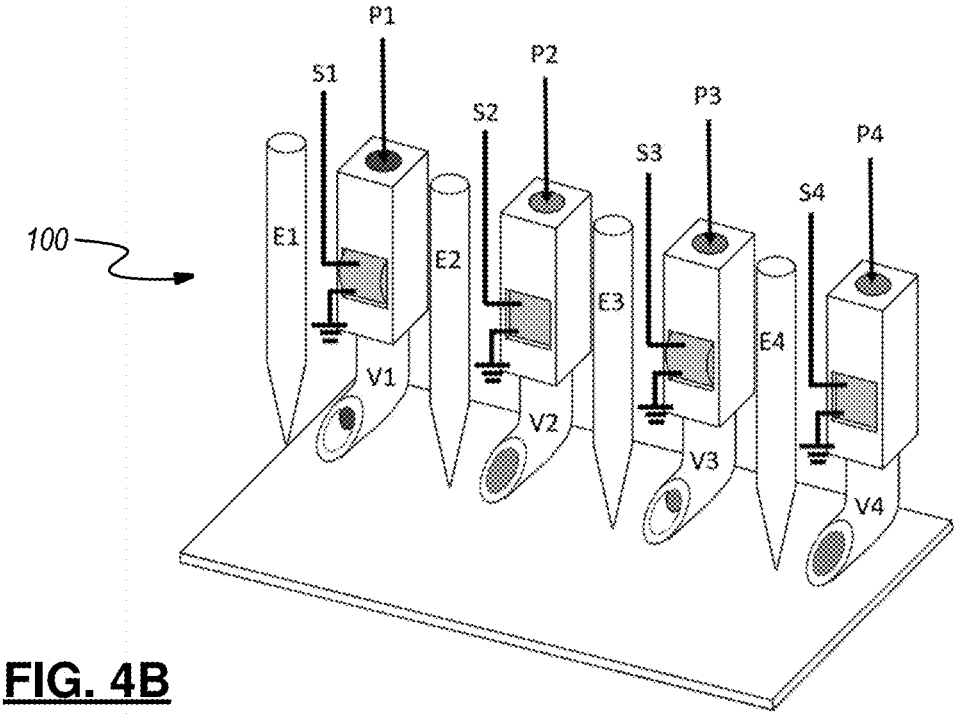

During the wetting process, the controller 18 is configured to selectively control electro-hydrodynamic transfer of ink from the ink reservoir 106 to the tip of the printing pin 104 in each of the print nozzles 102. To do so, the ink retraction mechanisms 110 are selectively activated to retract the ink away from the outlet of the ink reservoir 106 as seen in FIG. 4B. More specifically, the ink is transferred from the ink reservoir 106 to the tip of the printing pin 104 by creating an electric potential between the ink reservoir 106 and the printing pin 104. In this example, ink is going to be transferred to the tip of the printing pin in print nozzle #2 and #4. Therefore, a driving signal (e.g. of 10 volts) is applied to the ink retraction mechanisms 110 of print nozzles #1 and #3; whereas, no drive signal is applied to the ink retraction mechanisms of print nozzles #2 and #4.

Figure 4C:
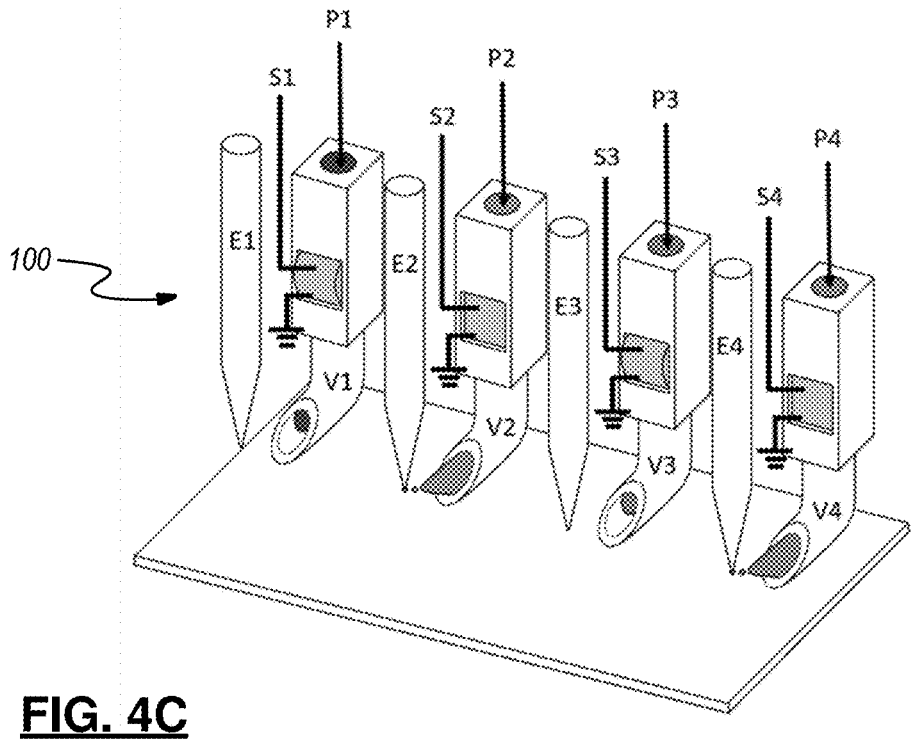

While continuing to activate the ink retraction mechanisms 110 of print nozzles #1 and #3, ink is transferred from the ink reservoir 106 to the tip of the printing pin 104 in print nozzles #2 and #4. In the example embodiment, a voltage (e.g., 400 volts) is applied to each of the ink reservoirs as indicated by V1, V2, V3, V4 while no voltage is applied to each of the printing pins. In this way, an electric potential is created between the printing pin 104 and the ink reservoir 106. Because ink is retracted in print nozzles #1 and #3, ink is transferred only to the tip of the printing pins 104 in print nozzles #2 and #4 as seen in FIG. 4C. The amount of ink transferred to the tip is determined by the duration of the electric potential created between the printing pin 104 and the ink reservoir 106. During this wetting process, note that the electrostatic field remains the same across all of the print nozzles 102. In some embodiments, a back pressure (e.g., 5 psi) may be applied to the ink in the ink reservoirs of print nozzles #2 and #4.

Figure 4D:
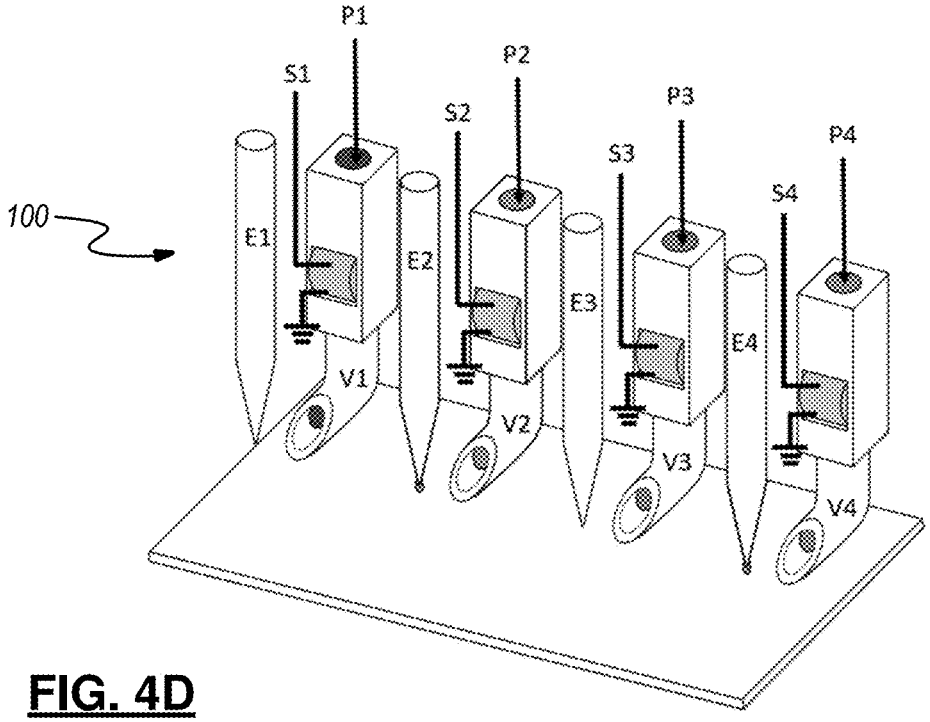

After wetting the printing pin, the controller 18 is configured to release the ink from the tip of the printing pin 104 during the jetting process. As an initial step in the jetting process, ink is retracted away from the outlet of the ink reservoir 106 in each of the print nozzles 102 as seen in FIG. 4D. Again, the ink retraction mechanisms 110 in each of the print nozzles 102 are activated by apply a drive signal to all of the print nozzles while there is no potential difference between the printing pins 104 and the ink reservoirs 106 in each of the print nozzles 102. For example, all of the conductive pins 104 and ink reservoirs 106 in the print nozzles 102 may be electrically grounded.

Figure 4E:
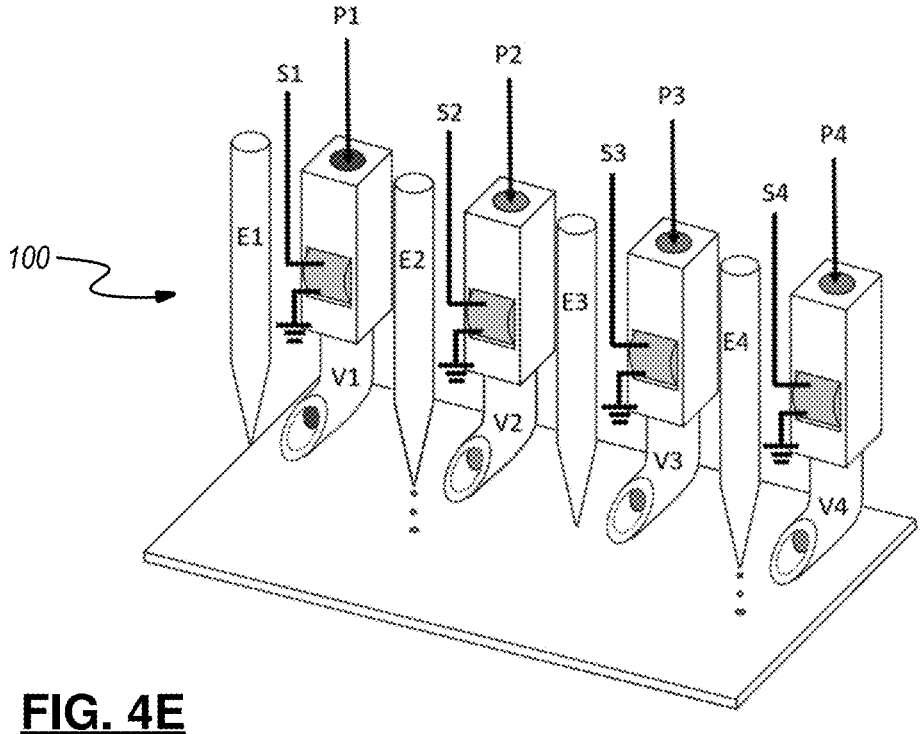

Next, the ink is released from the tips of the printing pins by creating an electrical potential between the printing pin 104 and the ink reservoir 106 in each of the print nozzles 102. In the example embodiment, a voltage (e.g., 250 volts) is applied to each of the ink reservoirs 106 as indicated by V1, V2, V3, V4 and a different voltage (e.g., 500 volts) is applied to each of the printing pins 104 as indicated by E1, E2, E3, E4. Because ink was transferred only to the tip of the printing pin in print nozzles #2 and #4, ink can only be released from print nozzles #2 and #4 onto the substrate 112 as seen in FIG. 4E. During this jetting process, note that the electrostatic field remains the same across all of the print nozzles 102.

Figure 4F:
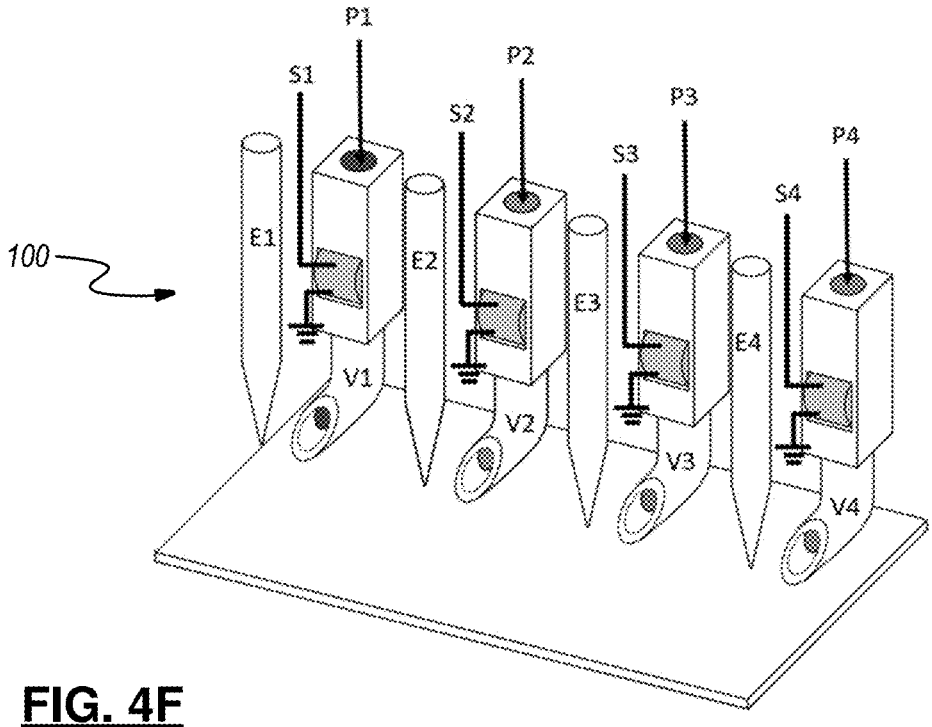

Once the ink has been deposited on the substrate 112, the electrical potential between the printing pin 104 and the ink reservoir 106 is removed. In the example embodiment, a voltage is no longer applied to the printing pin 104 and to the ink reservoir 106 in each of the print nozzles 102 as seen in FIG. 4F. Lastly, the ink retraction mechanisms 110 are deactivated by removing the drive signal and the print nozzles are returned to an idle state. In this way, the volume of ink released onto the substrate 112 is limited by the wetting process such that the pin/substrate standoff height no longer controls the volume of ink released and thereby allows controlled printing, for example on rough surfaces.

Figure 5:
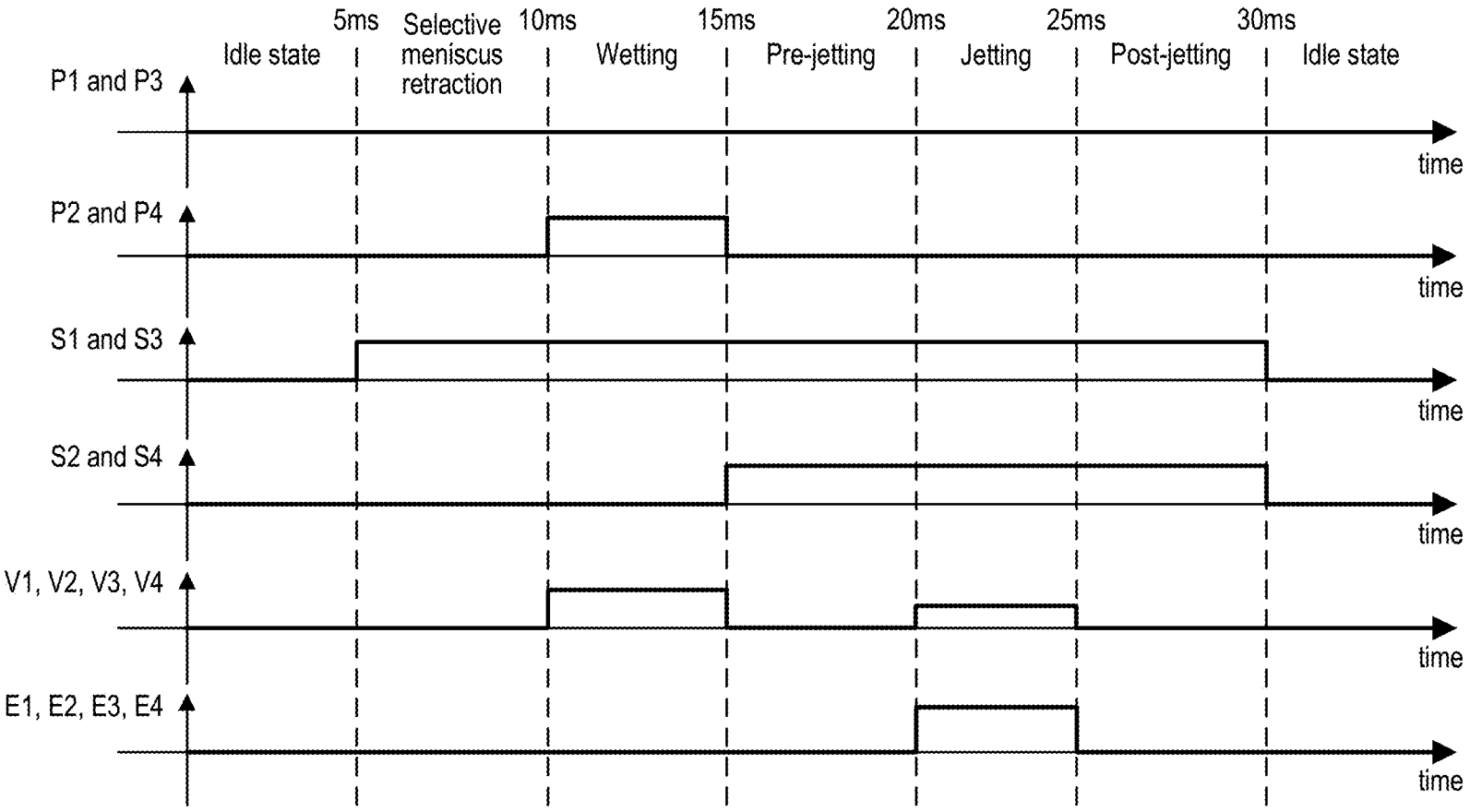
FIG. 5 is a timing diagram illustrating control signals for the first example embodiment of the multi-nozzle print head assembly.

In the example embodiment, the controller 108 is interfaced with each of the print nozzles 102 in the print head assembly 100. During the printing process, the controller 108 coordinates applying voltages and/or drive signals to each of the printing pins, ink reservoirs and ink retraction mechanisms. Signals coordinated by the controller are illustrated in a timing diagram shown in FIG. 5. It is readily understood that the diagram depicts a scenario where ink is ejected from print nozzles #2 and #4 and other scenarios would require a different timing sequence.

Figure 6:
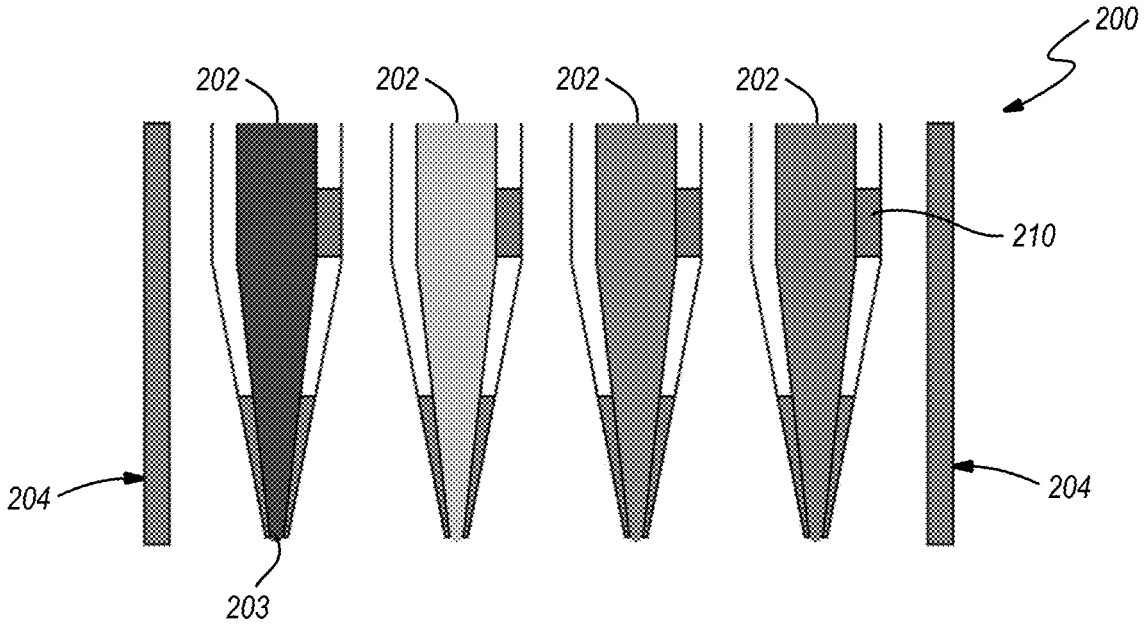
FIG. 6 depicts a second example embodiment of a multi-nozzle print head assembly.

FIG. 6 depicts another example embodiment of a multi-nozzle print head assembly 200 designed to operate with the same electrostatic field across all of the print nozzles 202. The print head assembly 200 includes a plurality of print nozzles 202 arranged adjacent to each other. In this embodiment, each print nozzle 202 is configured to hold ink and includes a tip 203 from which ink is emitted. A jetting mechanism 204 is arranged adjacent to the print nozzles 202 and configured to release ink from the print nozzles 202. More specifically, the jetting mechanism is implemented by one or more electrodes arranged around the periphery of the print nozzles 202. During the jetting process, ink is released by creating an electric potential between the electrodes of the jetting mechanism and the print nozzles. Although four print nozzles 202 are depicted, the print head assembly 200 may include more or less print nozzles 202.

Furthermore, each print nozzle 202 in the print head assembly 200 is further configured with an ink retraction mechanism 210. The ink retraction mechanism 210 is integrated into each print nozzle 202 and configured to retract ink away from the tip of the print nozzle 202. In one embodiment, the ink retraction mechanism 210 is a flex member comprised of piezoelectric material and formed into a side wall of the print nozzle 202. Other implementations for the ink retraction mechanism 210 are also contemplated by this disclosure.

Figure 7A:
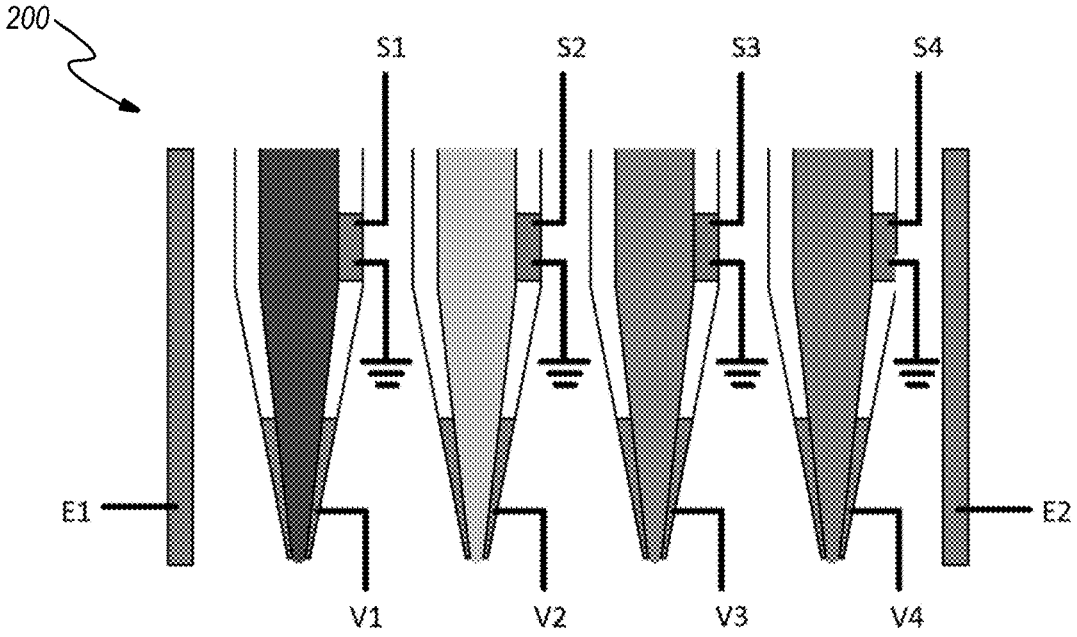
FIGS. 7A-7D illustrate operation of the second example embodiment of the multi-nozzle print head assembly.

Operation of the multi-nozzle print head assembly 200 is further described in relation to FIG. 7A-7D. In FIG. 7A, the printing process by the print head assembly 200 is in an idle state. In the idle state, there is no drive signal applied to the ink retraction mechanism 210 and thus the ink retraction mechanism 210 is in a deactivated state. The drive signals for the ink retraction mechanisms 210 are designated S1, S2, S3 and S4. Additionally, there is no electrical potential between the print nozzles 202 and the jetting mechanism 204 such that the ink meniscus is at or near the tip of the print nozzles. In the example embodiment, the print nozzles 202 and the jetting mechanism are electrically grounded (i.e., at 0 volts) during the idle state.

Figure 7B:
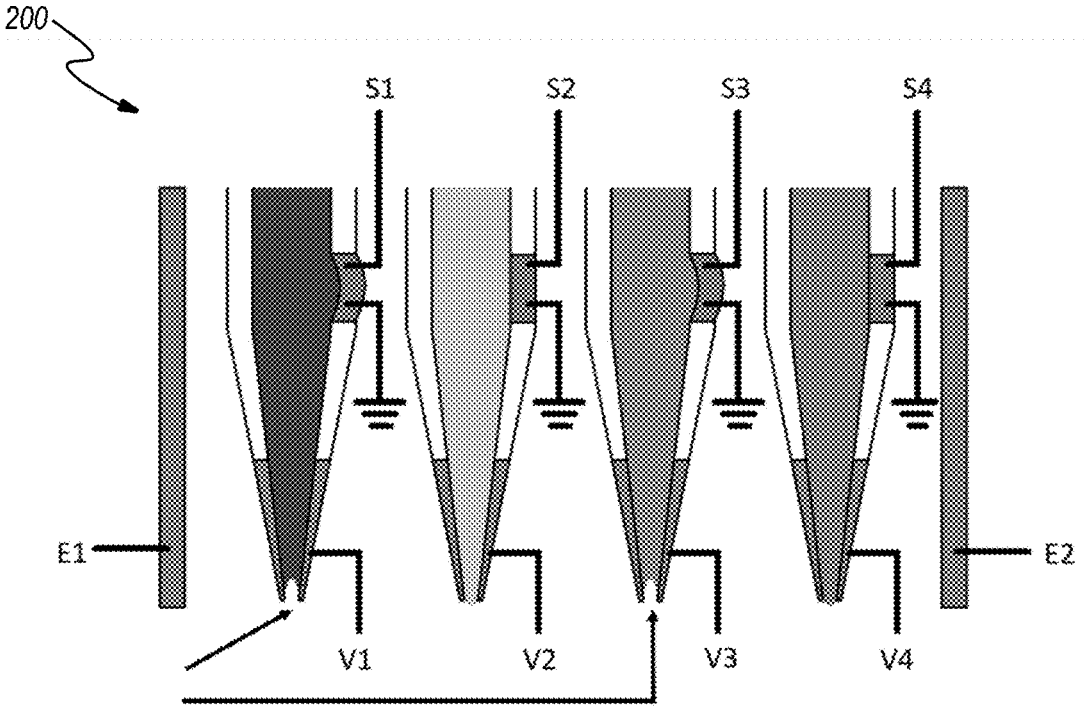

During a pre-jetting stage, the controller 208 interacts with select ink retraction mechanism 210 in the print nozzles 202 to retract ink away from the tip of the ink nozzle. With reference to FIG. 7B, a drive signal is applied to the ink retraction mechanisms 210 of print nozzles #1 and #3 but no drive signal is applied to the ink retraction mechanisms 210 of print nozzles #2 and #4. In this way, ink is retracted in print nozzles #1 and #3.

Figure 7C:
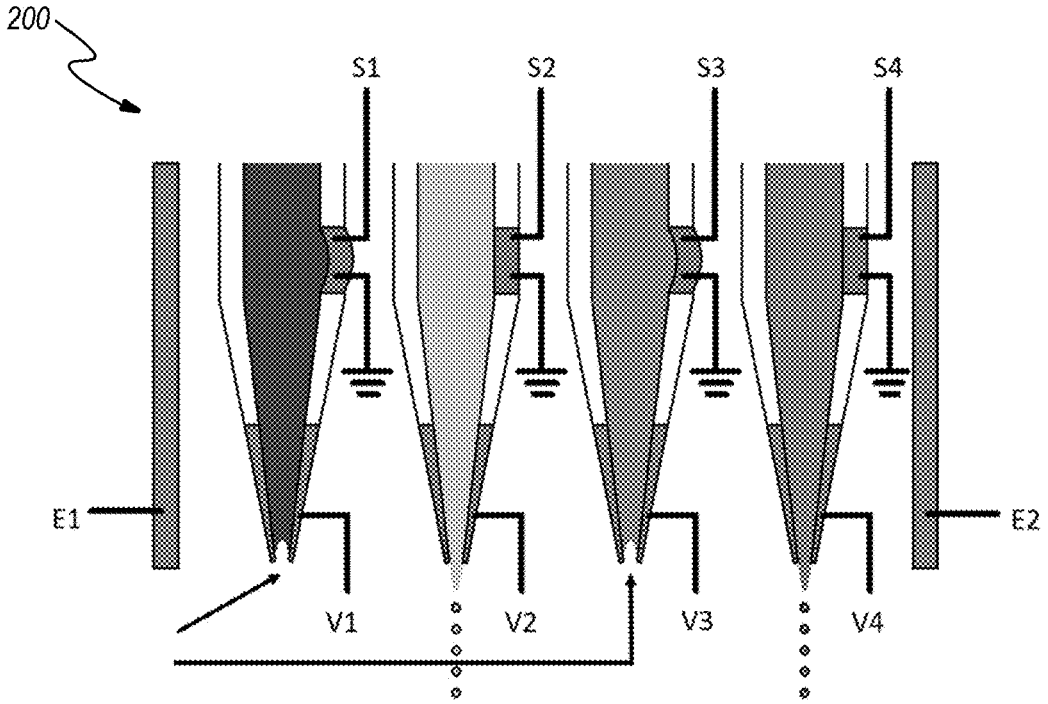
Figure 7D:
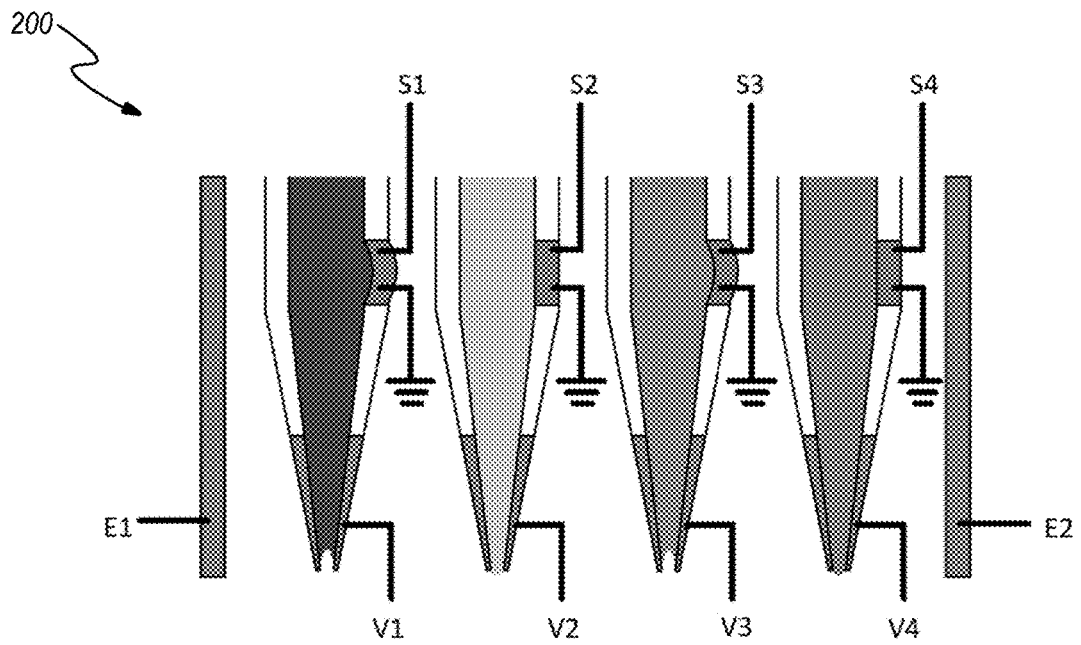

Next, the ink is released from the print nozzles 202 as seen in FIG. 7C. In this embodiment, ink is released from the print nozzles 202 by creating an electric potential between the printing nozzles 202 and the jetting mechanism 204. To create an electric potential, a voltage can be applied to the printing nozzles 202 and/or the jetting mechanism 204. The voltage applied to the printing nozzles 202 is designated V1, V2, V3, V4; whereas, the voltage applied to the jetting mechanism 204 is designated E1, E2. In this example, 500 volts is applied to the printing nozzles while 200 volts is applied to the electrodes of the jetting mechanism. Because ink is retracted in print nozzles #1 and #3, ink is released only from the tips of printing nozzles #2 and #4. Note that the electrostatic field remains the same across all of the print nozzles 102. In some embodiments, a back pressure (e.g., 5 psi) may be applied to the ink in print nozzles #2 and #4 as well.

After the jetting process, the electrical potential between the printing nozzles 202 and the jetting mechanism 204 is removed. In the example embodiment, a voltage is no longer applied to the printing nozzles 202 and the electrodes of the jetting mechanism 204. Lastly, the ink retraction mechanisms 210 are deactivated by removing the drive signal and the print nozzles are returned to an idle state.

Figure 8:
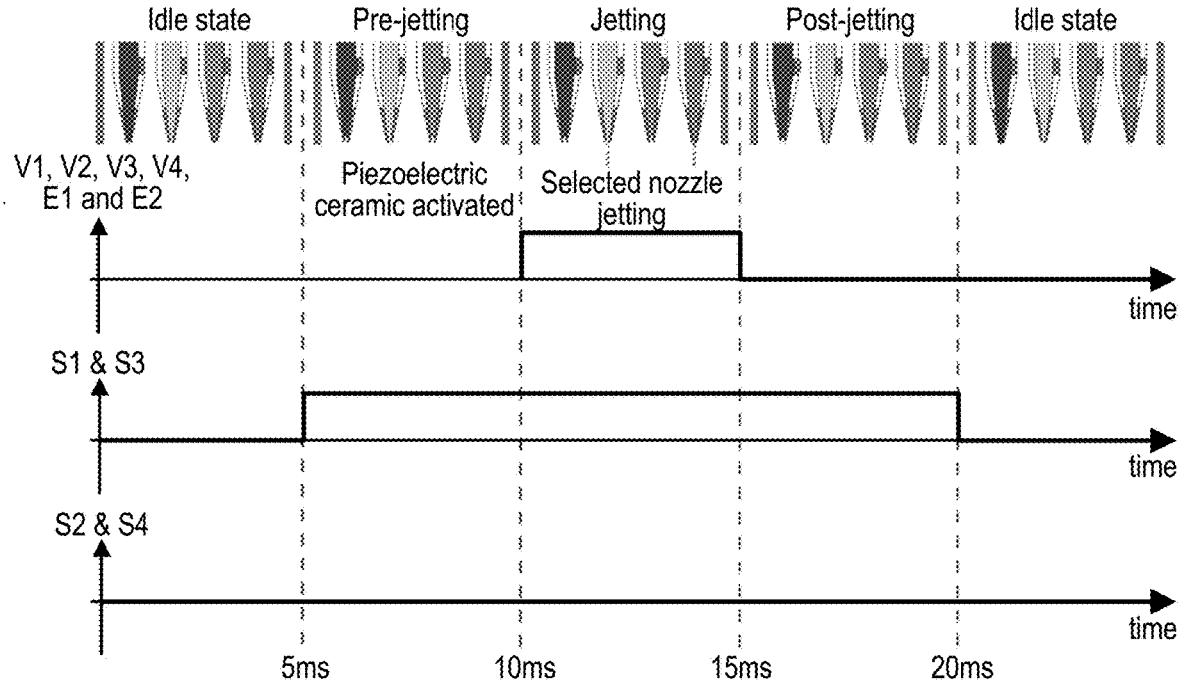
FIG. 8 is a timing diagram illustrating control signals for the second example embodiment of the multi-nozzle print head assembly.

In the example embodiment, the controller 108 is interfaced with each of the print nozzles 202 in the print head assembly 200. During the printing process, the controller 108 coordinates applying voltages and/or drive signals to each of the printing nozzles 202 and the jetting mechanisms 204. Signals coordinated by the controller are illustrated in a timing diagram shown in FIG. 8. It is readily understood that the diagram depicts a scenario where ink is ejected from print nozzles #2 and #4 and other scenarios would require a different timing sequence.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A print head assembly, comprising:

a plurality of print nozzles arranged adjacent to each other; each print nozzle in the plurality of print nozzles includes a printing pin;

a wetting mechanism associated with the printing pin, where the wetting mechanism includes an ink reservoir with an outlet arranged in close proximity to a tip of the printing pin; and an ink retraction mechanism integrated into the wetting mechanism and configured to retract ink away from the outlet of the ink reservoir; and a controller interfaced with each of the print nozzles in the plurality of print nozzles, wherein, during a wetting process, the controller is configured to selectively control electro-hydrodynamic transfer of ink from the ink reservoir to the tip of the printing pin in each of the print nozzles.

2. The print head assembly of claim 1 wherein the ink retraction mechanism includes a flex member comprised of a piezoelectric material, wherein the flex member is configured to create a vacuum in the ink reservoir in response to a drive signal from the controller.

3. The print head assembly of claim 1 wherein the ink retraction mechanism includes a flex member integrated into a wall of the ink reservoir and comprised of a piezoelectric material, wherein the flex member is configured to deform in response to a drive signal from the controller.

4. The print head assembly of claim 1 wherein the controller is interfaced with each of the ink retraction mechanisms in the plurality of print nozzles and interacts with ink retraction mechanisms in a subset of print nozzles in the plurality of print nozzles to retract ink away from the outlet of the ink reservoir while concurrently transferring ink from the ink reservoir to the tip of the printing pin in other print nozzles in the plurality of print nozzles.

5. The print head assembly of claim 4 wherein, during the wetting process, the controller creates an electric potential with same value across the printing pin and the ink reservoir of each print nozzle in the plurality of print nozzles.

6. The print head assembly of claim 5, wherein, during the jetting process, the controller creates an electric potential with same value across the printing pin and the ink reservoir of each print nozzle in the plurality of print nozzles.

7. The print head assembly of claim 1 wherein, for a given print nozzle in the plurality of print nozzles, the controller transfers ink from the ink reservoir to the tip of the printing pin by creating an electric potential between the printing pin and the ink reservoir in the given print nozzle.

8. The print head assembly of claim 1 wherein, during a jetting process, the controller is configured to release the ink from the tip of the printing pin in each of the print nozzles.

9. The print head assembly of claim 1 integrated into a printer.

10. A print nozzle assembly, comprising:

a printing pin;

a wetting mechanism associated with the printing pin, where the wetting mechanism includes an ink reservoir with an outlet arranged in close proximity to a tip of the printing pin; and an ink retraction mechanism integrated into the wetting mechanism and configured to retract ink away from the outlet of the ink reservoir.

11. The print nozzle assembly of claim 10 further comprises a controller is electrically coupled to one of the printing pin and the ink reservoir, wherein, during a wetting process, the controller is configured to selectively control electro-hydrodynamic transfer of ink from the ink reservoir to the tip of the printing pin.

12. The print nozzle assembly of claim 11 wherein the controller controls electro-hydrodynamic transfer of ink from the ink reservoir to the tip of the printing pin by creating an electric potential between the printing pin and the ink reservoir.

13. The print nozzle assembly of claim 12 wherein the ink retraction mechanism includes a flex member comprised of a piezoelectric material, wherein the flex member is configured to create a vacuum in the ink reservoir in response to a drive signal from the controller.

14. The print nozzle assembly of claim 12 wherein the ink retraction mechanism includes a flex member integrated into a wall of the ink reservoir and comprised of a piezoelectric material, wherein the flex member is configured to deform in response to a drive signal from the controller.

15. A print head assembly, comprising:

a plurality of print nozzles arranged adjacent to each other; each print nozzle is configured to hold ink and includes a tip from which ink is emitted;

an ink retraction mechanism integrated into each of the print nozzles in the plurality of print nozzles, wherein ink retraction mechanism is configured to retract ink away from the tip of print nozzle and back into the print nozzle;

a jetting mechanism arranged adjacent to the plurality of print nozzles and configured to release of ink from the plurality of print nozzles; and a controller interfaced with each of the print nozzles in the plurality of print nozzles, wherein, during a jetting process, the controller is configured to selectively release ink from each of the print nozzles in the plurality of print nozzles.

16. The print head assembly of claim 15 wherein the ink retraction mechanism includes a flex member comprised of a piezoelectric material, wherein the flex member is configured to create a vacuum inside the print nozzle in response to a drive signal from the controller.

17. The print head assembly of claim 15 wherein the ink retraction mechanism includes a flex member comprised of a piezoelectric material and integrated into a wall of a given print nozzle, wherein the flex member is configured to deform in response to a drive signal from the controller.

18. The print head assembly of claim 15 wherein the controller is interfaced with each of the ink retraction mechanisms in the plurality of print nozzles and interacts with ink retraction mechanisms in a subset of print nozzles in the plurality of print nozzles to retract ink away from the tip of the print nozzles while concurrently releasing ink from other print nozzles in the plurality of print nozzles.

19. The print head assembly of claim 15 wherein the jetting mechanism is further defined as one or more electrodes and the controller is configured to release ink by creating an electric potential between the one or more electrodes and each of the print nozzles.

20. The print head assembly of claim 19 wherein the controller creates an electric potential between the one or more electrodes and each of the print nozzles by applying a voltage with same value to each print nozzle in the plurality of print nozzles.

* * * * *